US007285940B2

(12) United States Patent
Kerth et al.

(10) Patent No.: US 7,285,940 B2
(45) Date of Patent: Oct. 23, 2007

(54) VOLTAGE REGULATOR WITH SHUNT FEEDBACK

(75) Inventors: Donald A. Kerth, Austin, TX (US); Russell Croman, Austin, TX (US); Brian D. Green, Austin, TX (US); Lysander Lim, Austin, TX (US); James Maligeorgos, Austin, TX (US); Xiachuan Guo, Austin, TX (US); Augusto M. Marques, Austin, TX (US)

(73) Assignee: NXP B.V., Eindhoven (NL)

( * ) Notice: Subject to any disclaimer, the term of this patent is extended or adjusted under 35 U.S.C. 154(b) by 169 days.

(21) Appl. No.: 11/220,958

(22) Filed: Sep. 7, 2005

(65) Prior Publication Data

US 2007/0052396 A1 Mar. 8, 2007

(51) Int. Cl.
*G05F 1/613* (2006.01)

(52) U.S. Cl. ..... 323/226; 323/273

(58) Field of Classification Search ..... 323/223, 323/226, 273, 311, 312, 349
See application file for complete search history.

(56) References Cited

U.S. PATENT DOCUMENTS 5,410,241 A * 4/1995 Cecil ..... 323/315
5,410,242 A 4/1995 Bittner ..... 323/315
5,506,493 A * 4/1996 Stengel ..... 323/223
5,510,699 A * 4/1996 Theus et al. ..... 323/312
5,909,109 A 6/1999 Phillips ..... 323/277
6,369,554 B1 4/2002 Aram ..... 323/282
6,841,981 B2 * 1/2005 Smith et al. ..... 323/312

FOREIGN PATENT DOCUMENTS

DE 4431466 C1 6/1995
DE 10213515 A1 12/2003

OTHER PUBLICATIONS

Computer translation of DE 102 13 515.*
David Johns et al., "Analog Integrated Circuit Design" University of Toronto, John Wiley & Sons Inc., ISBN 0-471-14448-7, 1997. pp. 246-248.
International Search Report and Written Opinion mailed Feb. 5, 2007, PCT/US2006/034512 (10 pgs.)
"TL431/TL431A Programmable Shunt Regulator" 2003 Fairchild Semiconductor Corporation. Rev. 1.0.3, p. 1-6 XP002415681, www.fairchildsemi.com.

* cited by examiner

*Primary Examiner*—Jeffrey Sterrett
(74) *Attorney, Agent, or Firm*—Peter Zawilski

(57) ABSTRACT

A voltage regulator configured to receive a supply voltage from a voltage supply and provide a regulated voltage to digital circuitry is provided. The voltage regulator comprises first circuitry configured to inhibit high frequency energy generated by the digital circuitry from transmitting into the voltage supply, second circuitry configured to inhibit low frequency energy generated by the digital circuitry from transmitting into the voltage supply, and third circuitry configured to maintain the regulated voltage at a substantially constant value in response to a current drawn by the digital circuitry.

26 Claims, 6 Drawing Sheets

VOLTAGE REGULATOR WITH SHUNT FEEDBACK

BACKGROUND

In various types of electrical circuits, electromagnetic interference may cause problems with the operation of the circuits. The interference may increase when circuit elements are spaced in close proximity to one another, e.g., by integrating the circuit elements on the same circuit, when a relatively large amount of power is used by circuit elements, or when operating frequencies of different circuit components overlap. Although interference may be reduced by increasing the spacing between circuit elements or electrically isolating circuit elements, the size of the overall circuit may be increased and additional circuitry added to isolate circuit elements may increase interference.

It would be desirable to be able to minimize interference between circuit elements without increasing the size of the overall circuit.

SUMMARY

According to one exemplary embodiment, a voltage regulator configured to receive a supply voltage from a voltage supply and provide a regulated voltage to digital circuitry is provided. The voltage regulator comprises first circuitry configured to inhibit high frequency energy generated by the digital circuitry from transmitting into the voltage supply, second circuitry configured to inhibit low frequency energy generated by the digital circuitry from transmitting into the voltage supply, and third circuitry configured to maintain the regulated voltage at a substantially constant value in response to a current drawn by the digital circuitry.

According to another exemplary embodiment, a method performed by a voltage regulator is provided. The method comprises receiving a supply voltage from a voltage supply, providing a regulated voltage to digital circuitry, inhibiting high frequency energy generated by the digital circuitry using the regulated voltage from transmitting into the voltage supply, inhibiting low frequency energy generated by the digital circuitry using the regulated voltage from transmitting into the voltage supply, and maintaining the regulated voltage at a substantially constant value in response to a first current drawn by the digital circuitry.

According to a further exemplary embodiment, a system comprising digital circuitry and a voltage regulator configured to receive a supply voltage from a voltage supply and provide a regulated voltage to the digital circuitry is provided. The voltage regulator is configured to inhibit high frequency energy generated by the digital circuitry from transmitting into the voltage supply, the voltage regulator is configured to inhibit low frequency energy generated by the digital circuitry from transmitting into the voltage supply, and the voltage regulator is configured to maintain the regulated voltage at a substantially constant value in response to a first current drawn by the digital circuitry.

According to another exemplary embodiment, a communications device is provided. The communications device comprises an antenna, a mobile communications system configured to communicate with a remote host using the antenna and including a voltage supply, digital circuitry, and a voltage regulator configured to receive a supply voltage from the voltage supply and provide a regulated voltage to the digital circuitry, and an input/output system configured to communicate with the mobile communications system. The voltage regulator is configured to inhibit high frequency energy generated by the digital circuitry from transmitting into the voltage supply, the voltage regulator is configured to inhibit low frequency energy generated by the digital circuitry from transmitting into the voltage supply, and the voltage regulator is configured to maintain the regulated voltage at a substantially constant value in response to a first current drawn by the digital circuitry.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Embodiments of a voltage regulator that provides a well-regulated voltage to digital circuitry and inhibits interference from the digital circuitry, such as spurious high and low frequency energy, from transmitting into a voltage supply are described herein. Accordingly, the voltage regulator contains the interference to prevent the interference from adversely affecting the operation of other circuitry.

Figure 1:
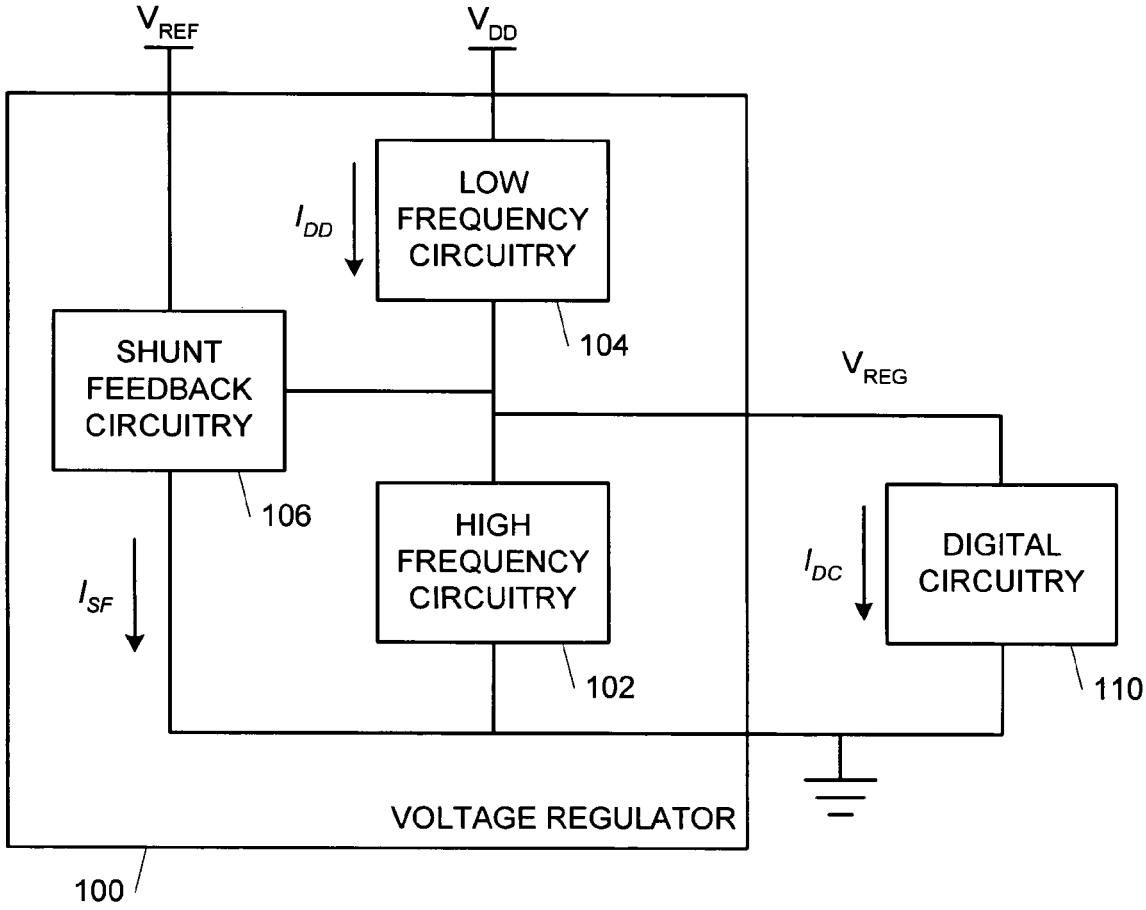
FIG. 1 is a block diagram illustrating one embodiment of a voltage regulator coupled to digital circuitry.

FIG. 1 is a block diagram illustrating one embodiment of a voltage regulator 100 coupled to digital circuitry 110. Voltage regulator 100 includes high frequency circuitry 102, low frequency circuitry 104, and shunt feedback circuitry 106.

Voltage regulator 100 receives a supply voltage $V_{DD}$ and a reference voltage $V_{REF}$ and generates a regulated voltage $V_{REG}$. Voltage regulator 100 provides the regulated voltage to digital circuitry 110.

Digital circuitry 110 is configured to operate using the regulated voltage provided by voltage regulator 100 and draws varying amounts of current from voltage regulator 100. Digital circuitry 110 is configured to perform one or more functions as an independent circuit or as part of a system that includes other circuitry (not shown in FIG. 1). In one embodiment, digital circuitry 110 forms part of a mobile communications system for use in a GSM (Global System for Mobile Communications) network. For example, digital circuitry 110 amy form a digital signal processing (DSP) circuit or a divide-by-N circuit in a mobile communications system. In other embodiments, digital circuitry 110 may be included another type of communications system or another type of electronic device configured to perform other types of functions.

In one embodiment, digital circuitry 110 generates or otherwise produces interference that may inhibit or otherwise adversely affect the operation of other circuitry (not shown). The other circuitry may be in a system that includes digital circuitry 110 or otherwise proximately located to digital circuitry 110 such that the interference may inhibit or adversely affect the operation of the other circuitry.

In one embodiment, digital circuitry 110 generates interference in the form of high and low frequency energy that may adversely affect the operation of other circuitry. The high and low frequency energy may be generated by an oscillatory source, such as a clock or other circuitry in digital circuitry 110, associated with digital circuitry 110 that operates at one or more frequencies. The high and low frequency energy may occur relative to one or more frequencies of the oscillatory source where the low frequency energy is closer to one or more frequencies of the oscillatory source than the high frequency energy.

For example, in an embodiment where digital circuitry 110 operates using a 26 MHz clock, the low order harmonics of the clock, such as the first and second harmonics, may generate low frequency energy and the high order harmonics of the clock may generate high frequency energy. In this example, the low frequency energy may adversely affect the operation of a voltage-controlled oscillator (VCO) (not shown) by causing pulling problems with the VCO by modulating the impedance presented in the voltage supply. In addition, high frequency energy may adversely affect the operation of transmitter or receiver circuitry (not shown in FIG. 1) that is proximately located to digital circuitry 110 where the high frequency energy is near the frequency of operation of the transmitter or receiver circuitry.

Voltage regulator 100 is configured to prevent interference such as high and low frequency energy generated by digital circuitry 110 from adversely affecting the operation of other circuitry in a system that includes digital circuitry 110. In the embodiment shown in FIG. 1, high frequency circuitry 102 is configured to inhibit high frequency energy generated by digital circuitry 110 from transmitting into the voltage supply that provides the supply voltage $V_{DD}$. Similarly, low frequency circuitry 104 is configured to inhibit low frequency energy generated by digital circuitry 110 from transmitting into the voltage supply that provides the supply voltage.

Voltage regulator 100 is also configured to provide a well regulated voltage $V_{REG}$ to digital circuitry 110 such that the regulated voltage does not vary with the amount of current drawn by digital circuitry 110. In the embodiment shown in FIG. 1, shunt feedback circuitry 106 is configured to provide the regulated voltage to digital circuitry 110 using the reference voltage $V_{REF}$ and the supply voltage $V_{DD}$. Shunt feedback circuitry 106 maintains the regulated voltage according to the amount of current drawn by digital circuitry 110 to provide a constant, well regulated voltage to digital circuitry 110. In one embodiment, shunt feedback circuitry 106 is configured to cause the regulated voltage, $V_{REG}$, to be equal to the reference voltage $V_{REF}$.

To ensure that the regulated voltage remains constant, shunt feedback circuitry 106 is configured to continuously adjust the amount of current it draws in response to changes in the amount of current drawn by digital circuitry 110. In operation, shunt feedback circuitry 106 increases the amount of current it draws in response to a decrease in the amount of current drawn by digital circuitry 110. By doing so, shunt feedback circuitry 106 ensures that the regulated voltage does not increase as a result of the decrease in the amount of current drawn by digital circuitry 110. Similarly, shunt feedback circuitry 106 decreases the amount of current it draws in response to an increase in the amount of current drawn by digital circuitry 110. By doing so, shunt feedback circuitry 106 ensures that the regulated voltage does not decrease as a result of the increase in the amount of current drawn by digital circuitry 110.

In one embodiment, the current through shunt feedback circuitry 106, $I_{SF}$, is approximated as a difference between the current from the voltage supply, $I_{DD}$, and the current drawn by digital circuitry 110, $I_{DC}$, as shown in Equation I.

$$I_{SF}=I_{DD}-I_{DC} \qquad \text{EQUATION I}$$

Figure 2:
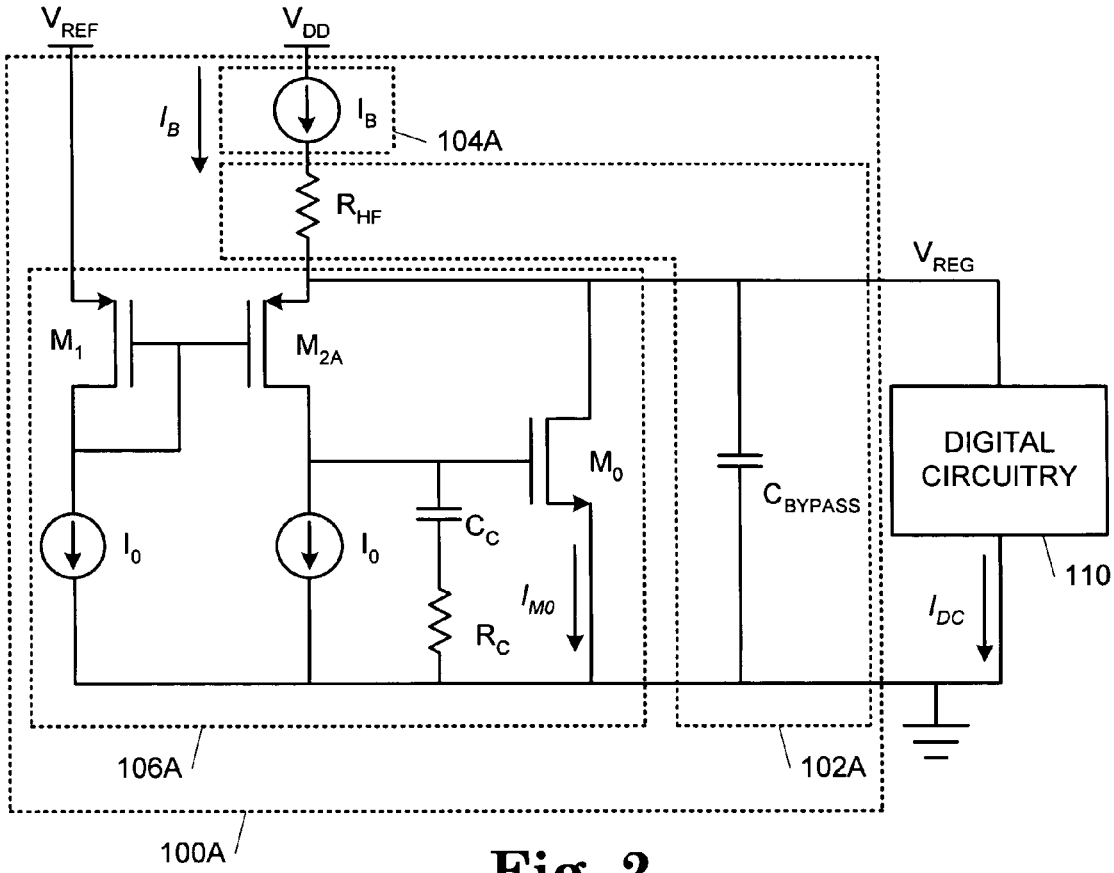
FIG. 2 is a block diagram illustrating another embodiment of a voltage regulator coupled to digital circuitry.

FIG. 2 is a block diagram illustrating another embodiment 100A of voltage regulator 100 that is coupled to digital circuitry 110. In the embodiment of FIG. 2, voltage regulator 100A includes an embodiment 102A of high frequency circuitry 102, an embodiment 104A of low frequency circuitry 104, and an embodiment 106A of shunt feedback circuitry 106. Voltage regulator 100A receives the supply voltage, $V_{DD}$, and the reference voltage $V_{REF}$ and generates a regulated voltage $V_{REG}$. Voltage regulator 100A provides the regulated voltage to digital circuitry 110.

Voltage regulator 100A is configured to prevent interference such as high and low frequency energy generated by digital circuitry 110 from adversely affecting the operation of other circuitry in a system that includes digital circuitry 110. Voltage regulator 100A is also configured to provide a well regulated voltage $V_{REG}$ to digital circuitry 110 such that the regulated voltage does not vary with the amount of current drawn by digital circuitry 110.

In the embodiment shown in FIG. 2, high frequency circuitry 102A includes a capacitive element $C_{BYPASS}$ connected between the regulated voltage node and ground and a resistive element $R_{HF}$ connected between the supply voltage and the regulated voltage node. The capacitive element $C_{BYPASS}$ and the resistive element $R_{HF}$ combine to form a circuit that operates as a low pass filter. By operating as a low pass filter, the capacitive element $C_{BYPASS}$ and the resistive element $R_{HF}$ inhibit high frequency energy generated by digital circuitry 110 from transmitting into the voltage supply that provides the supply voltage, $V_{DD}$.

In the embodiment of FIG. 2, low frequency circuitry 104A includes a current source configured to generate a constant current $I_B$ between the supply voltage and the regulated voltage node. In the embodiment shown in FIG. 2, constant current $I_B$ connects between the supply voltage and resistive element $R_{HF}$. In other embodiments, constant current $I_B$ connects between resistive element $R_{HF}$ and the regulated voltage node. By generating the constant current $I_B$, low frequency circuitry 104A inhibits low frequency energy generated by digital circuitry 110 from transmitting into the voltage supply that provides the supply voltage.

In the embodiment of FIG. 2, shunt feedback circuitry 106A includes p-channel transistors $M_1$ and $M_{2A}$, n-channel transistor $M_0$, two constant current sources $I_0$, a capacitive element $C_C$ and a resistive element $R_C$. In the embodiment of FIG. 2, transistors $M_1$ and $M_{2A}$ are equally sized. In other embodiments, transistors $M_1$ and $M_{2A}$ sized such that the size of transistor $M_1$ is a whole number multiple n of the size of transistor $M_{2A}$ or sized such that the size of transistor $M_{2A}$ is a whole number multiple n of the size of transistor $M_1$.

The source connection of transistor $M_1$ connects to the reference voltage, and the gate connection of transistor $M_1$ connects to the drain connection of transistor $M_1$. Accordingly, transistor $M_1$ is configured to form a diode. The source connection of transistor $M_{2A}$ connects to the regulated voltage node, and the gate connection of transistor $M_{2A}$ connects to the gate connection of transistor $M_1$. One of the current sources $I_0$ is connected between the gate and drain connections of transistor $M_1$ and ground. The other current source $I_0$ is connected between the drain connection of transistor $M_{2A}$ and ground. The capacitive element $C_C$ and the resistive element $R_C$ connect in series between the gate of transistor $M_0$ and ground. The source connection of transistor $M_0$ connects to the regulated voltage node, the gate connection of transistor $M_0$ connects to the drain connection of transistor $M_{2A}$, and the drain connection of transistor $M_0$ connects to ground.

Shunt feedback circuitry 106A is configured to provide the regulated voltage to digital circuitry 110 using the reference voltage $V_{REF}$ and the supply voltage $V_{DD}$. Shunt feedback circuitry 106A maintains the regulated voltage according to the amount of current drawn by digital circuitry 110 to provide a constant, well regulated voltage to digital circuitry 110.

Shunt feedback circuitry 106A is configured to cause the regulated voltage to be approximately equal to the reference voltage $V_{REF}$. The constant current sources $I_0$ cause the voltage at the source connections of transistors $M_1$ and $M_{2A}$ to be constant and equal. Because transistors $M_1$ and $M_{2A}$ are equally sized, the regulated voltage is approximately equal to the reference voltage.

To ensure that the regulated voltage remains constant, shunt feedback circuitry 106A continuously adjusts the amount of current drawn by transistor $M_0$ from the regulated voltage in response to changes in the amount of current drawn by digital circuitry 110. Transistor $M_0$ provides active shunt feedback to cause the regulated voltage to be equal to the reference voltage regardless of current through digital circuitry 110.

In operation, transistor $M_0$ increases the amount of current it draws from current supply $I_B$ in response to a decrease in the amount of current drawn by digital circuitry 110. By doing so, transistor $M_0$ ensures that the regulated voltage does not increase as a result of the decrease in the amount of current drawn by digital circuitry 110. Similarly, transistor $M_0$ decreases the amount of current it draws from current supply $I_B$ in response to an increase in the amount of current drawn by digital circuitry 110. By doing so, transistor $M_0$ ensures that the regulated voltage does not decrease as a result of the increase in the amount of current drawn by digital circuitry 110.

In one embodiment, the current through transistor $M_0$, $I_{M0}$, is approximated as a difference between the current $I_B$ from the current supply $I_B$ and the current $I_{DC}$ drawn by digital circuitry 110 as shown in Equation II.

$$I_{M0}=I_B-I_{DC} \qquad \text{EQUATION II}$$

In one embodiment, capacitive element $C_{BYPASS}$ is relatively large to provide high frequency attenuation. As a result, capacitive element $C_{BYPASS}$ creates a dominant pole at the regulated voltage node. Shunt feedback circuitry 106A includes capacitive element $C_C$ and resistive element $R_C$ to provide frequency compensation for pole created at the regulated voltage node by $C_{BYPASS}$. Accordingly, capacitive element $C_C$ and resistive element $R_C$ provide circuit stability for voltage regulator 100A.

Figure 3:
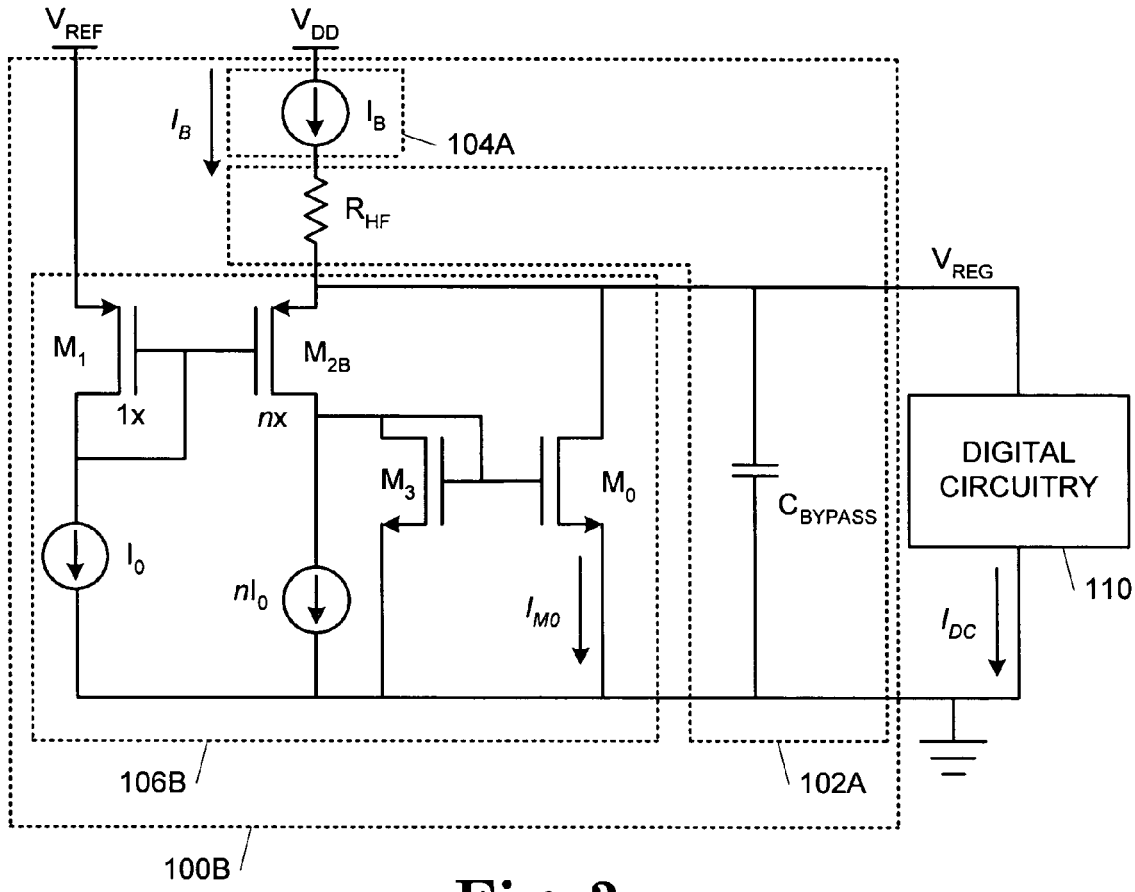
FIG. 3 is a block diagram illustrating a further embodiment of a voltage regulator coupled to digital circuitry.

FIG. 3 is a block diagram illustrating a further embodiment 100B of voltage regulator 100 that is coupled to digital circuitry 110. In the embodiment of FIG. 3, voltage regulator 100B includes high frequency circuitry 102A, low frequency circuitry 104A, and an embodiment 106B of shunt feedback circuitry 106. Voltage regulator 100B receives the supply voltage $V_{DD}$ and the reference voltage $V_{REF}$ and generates the regulated voltage $V_{REG}$. Voltage regulator 100B provides the regulated voltage to digital circuitry 110.

Voltage regulator 100B is configured to prevent interference such as high and low frequency energy generated by digital circuitry 110 from adversely affecting the operation of other circuitry in a system that includes digital circuitry 110. Voltage regulator 100B is also configured to provide a well regulated voltage $V_{REG}$ to digital circuitry 110 such that the regulated voltage does not vary with the amount of current drawn by digital circuitry 110. High frequency circuitry 102 A and low frequency circuitry 104A operate as described above with reference to FIG. 2.

In the embodiment of FIG. 3, shunt feedback circuitry 106B includes p-channel transistors $M_1$ and $M_{2B}$, n-channel transistors $M_0$ and $M_3$, and two constant current sources $I_0$ and $nI_0$. In the embodiment of FIG. 3, transistors $M_1$ and $M_{2B}$ are sized such that the size of transistor $M_{2B}$ is a whole number multiple n of the size of transistor $M_1$. In other embodiments, transistors $M_1$ and $M_{2B}$ are equally sized or sized such that the size of transistor $M_1$ is a whole number multiple n of the size of transistor $M_{2B}$. Constant current sources $I_0$ and $nI_0$ are also sized such that the current generated by current source $nI_0$ is a whole number multiple n of the current generated by current source $I_0$.

The source connection of transistor $M_1$ connects to the reference voltage, and the gate connection of transistor $M_1$ connects to the drain connection of transistor $M_1$. Accordingly, transistor $M_1$ is configured to form a diode. The source connection of transistor $M_{2B}$ connects to the regulated voltage node, and the gate connection of transistor $M_{2B}$ connects to the gate connection of transistor $M_1$. The current source $I_0$ is connected between the gate and drain connections of transistor $M_1$ and ground. The current source $nI_0$ is connected between the drain connection of transistor $M_{2B}$ and ground. The drain and gate connections of transistor $M_3$ connects to the drain connection of transistor $M_{2B}$, and the source connection of transistor $M_3$ connects to ground. Accordingly, transistor $M_3$ is configured to form a diode. The drain connection of transistor $M_0$ connects to the regulated voltage node, the gate connection of transistor $M_0$ connects to the drain and gate connections of transistor $M_3$, and the source connection of transistor $M_0$ connects to ground.

Shunt feedback circuitry 106B is configured to provide the regulated voltage to digital circuitry 110 using the reference voltage $V_{REF}$ and the supply voltage $V_{DD}$. Shunt feedback circuitry 106B maintains the regulated voltage according to the amount of current drawn by digital circuitry 110 to provide a constant, well regulated voltage to digital circuitry 110.

Shunt feedback circuitry 106A is configured to cause the regulated voltage to be approximately equal to the reference voltage $V_{REF}$. The constant current sources $I_0$ and $nI_0$ cause the voltage at the source connections of transistors $M_1$ and $M_{2B}$ to be constant and equal. Because transistors $M_1$ and $M_{2B}$ are proportionately sized with their drain currents $I_0$ and $nI_0$, the regulated voltage is approximately equal to the reference voltage.

To ensure that the regulated voltage remains constant, shunt feedback circuitry 106B continuously adjusts the amount of current drawn by transistor $M_0$ from the supply voltage in response to changes in the amount of current drawn by digital circuitry 110. Transistor $M_0$ provides active shunt feedback to cause the regulated voltage to be equal to the reference voltage regardless of current through digital circuitry 110.

In operation, transistor $M_0$ increases the amount of current it draws from current supply $I_B$ in response to a decrease in the amount of current drawn by digital circuitry 110. By doing so, transistor $M_0$ ensures that the regulated voltage does not increase as a result of the decrease in the amount of current drawn by digital circuitry 110. Similarly, transistor $M_0$ decreases the amount of current it draws from current supply $I_B$ in response to an increase in the amount of current drawn by digital circuitry 110. By doing so, transistor $M_0$ ensures that the regulated voltage does not decrease as a result of the increase in the amount of current drawn by digital circuitry 110.

In one embodiment, the current through transistor $M_0$, $I_{M0}$, is approximated as a difference between the current $I_B$ from the current supply $I_B$ and the current $I_{DC}$ drawn by digital circuitry 110 as shown in Equation II above.

In one embodiment, capacitive element $C_{BYPASS}$ is relatively large to provide high frequency attenuation. As a result, capacitive element $C_{BYPASS}$ creates a dominant pole at the regulated voltage node. Shunt feedback circuitry 106A includes the diode connected transistor $M_3$ to provide frequency compensation for pole created at the regulated voltage node by $C_{BYPASS}$. The diode connected transistor $M_3$ forms a frequency compensation circuit that causes the pole at the node of the gate connection of transistor $M_0$ to be non-dominant when compared with the regulated voltage node. Accordingly, the diode connected transistor $M_3$ provides circuit stability for voltage regulator 100B.

Figure 4:
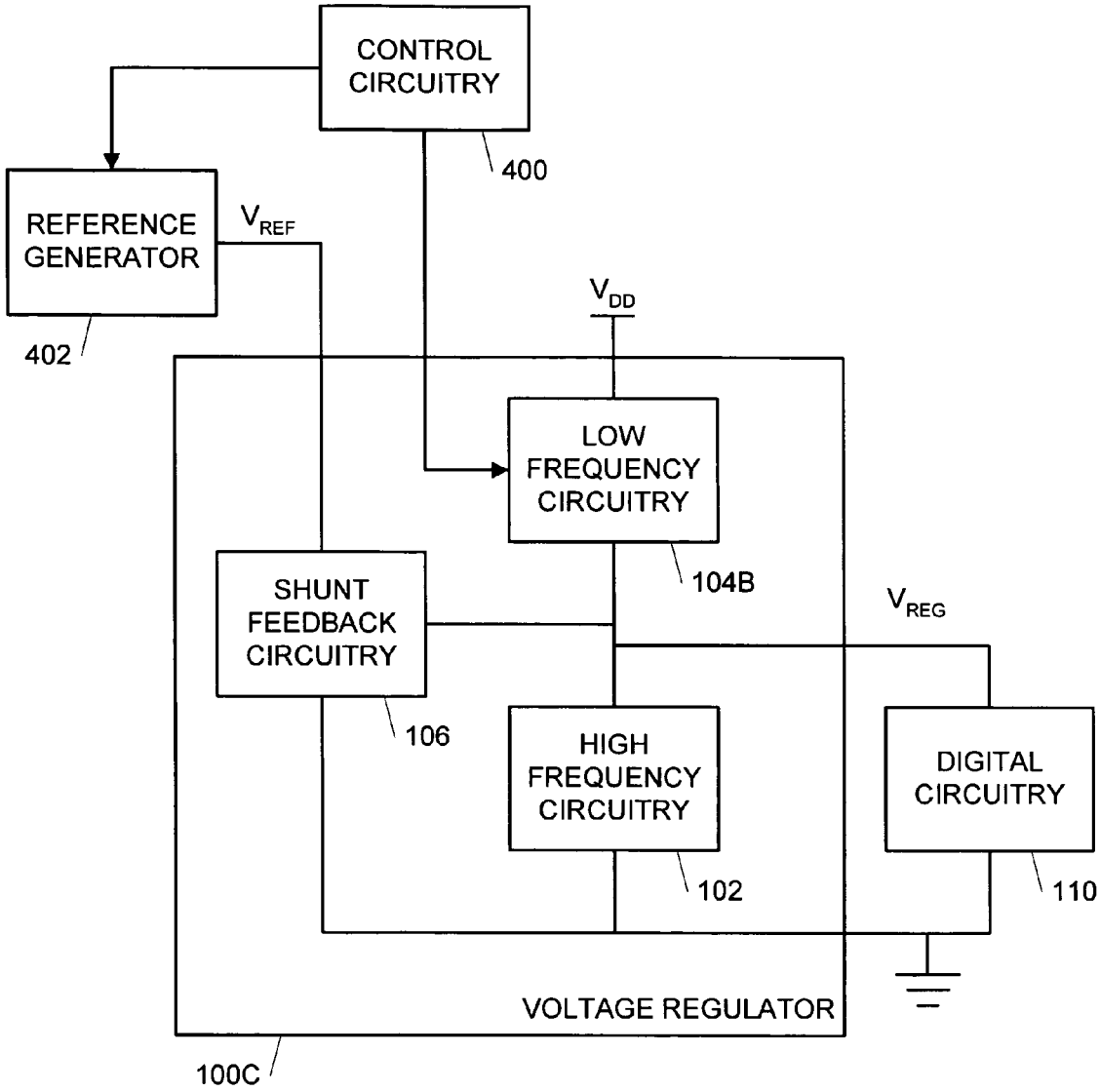
FIG. 4 is a block diagram illustrating one embodiment of a voltage regulator coupled to digital circuitry and operated by control circuitry.

FIG. 4 is a block diagram illustrating an embodiment 100C of voltage regulator 100 that is coupled to digital circuitry 110 and operated by control circuitry 400. Voltage regulator 100C includes high frequency circuitry 102, low frequency circuitry 104B, and shunt feedback circuitry 106. Voltage regulator 100C receives supply voltage $V_{DD}$ and reference voltage $V_{REF}$ and generates regulated voltage $V_{REG}$. Voltage regulator 100C provides the regulated voltage to digital circuitry 110.

Voltage regulator 100C operates similarly to voltage regulator 100 as described above with reference to FIG. 1 to provide a regulated voltage to digital circuitry 110. In FIG. 4, however, control circuitry 400 adjusts the regulated voltage provided by voltage regulator 100C by adjusting a reference generator 402 and an embodiment 104B of low frequency circuitry 104.

Control circuitry 400 is configured to adjust reference generator 402 to adjust the reference voltage provided by reference generator 402 to voltage regulator 100C thus controlling the regulated voltage $V_{REG}$. Control circuitry 400 is also configured to adjust low frequency circuitry 104B. In one embodiment where low frequency circuitry 104B includes current source $I_B$ as shown in the embodiment 104A in FIGS. 2 and 3, control circuitry 400 adjusts current source $I_B$ to control the amount of constant current provided by current source $I_B$.

By providing an adjustable regulated voltage to digital circuitry 110, voltage regulator 100C allows the regulated voltage to be tailored for use with digital circuitry 110. In addition, the power consumption of voltage regulator 100C may adjusted by adjusting low frequency circuitry 104B such as current source $I_B$.

Figure 5:
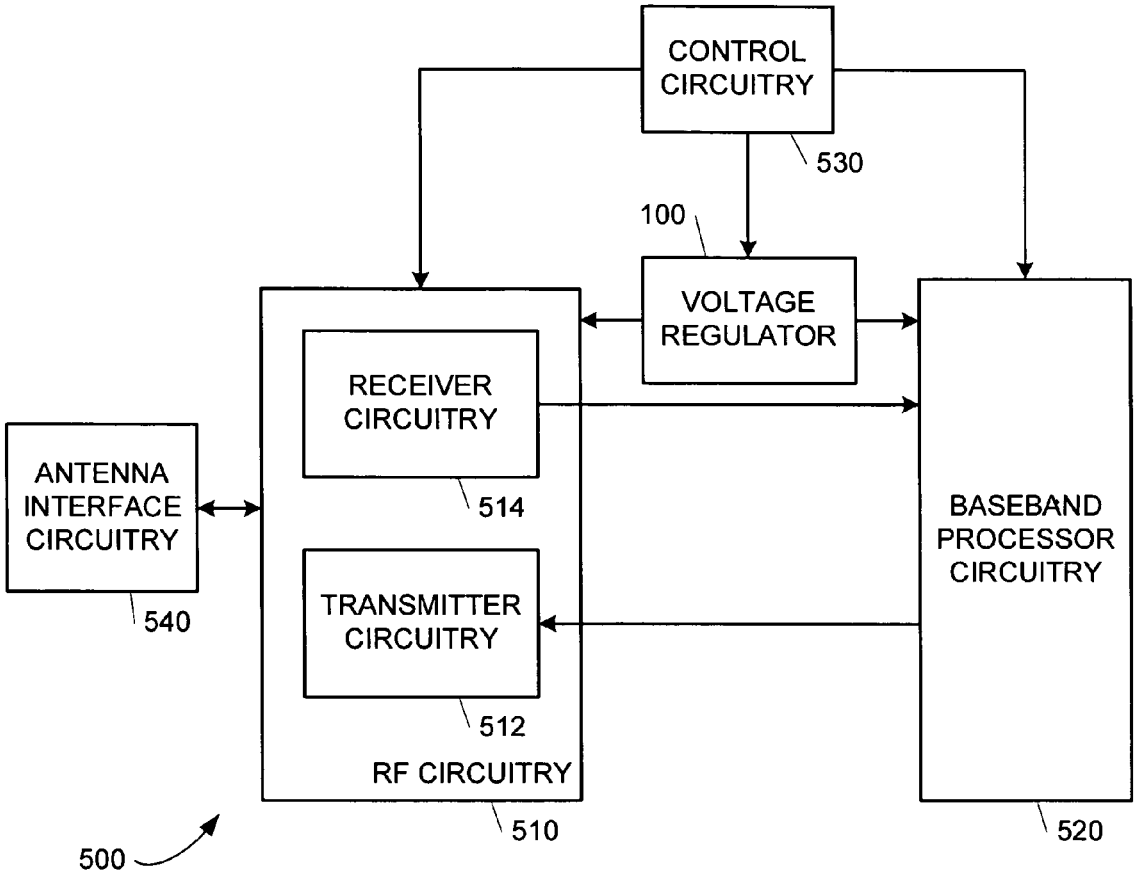
FIG. 5 is a block diagram illustrating one embodiment of a mobile communication system.

FIG. 5 is a block diagram illustrating one embodiment of a mobile communications system 500. System 500 includes radio-frequency (RF) circuitry 510, baseband processor circuitry 520, control circuitry 530, antenna interface circuitry 540, and one or more instances of voltage regulator 100.

Figure 6:
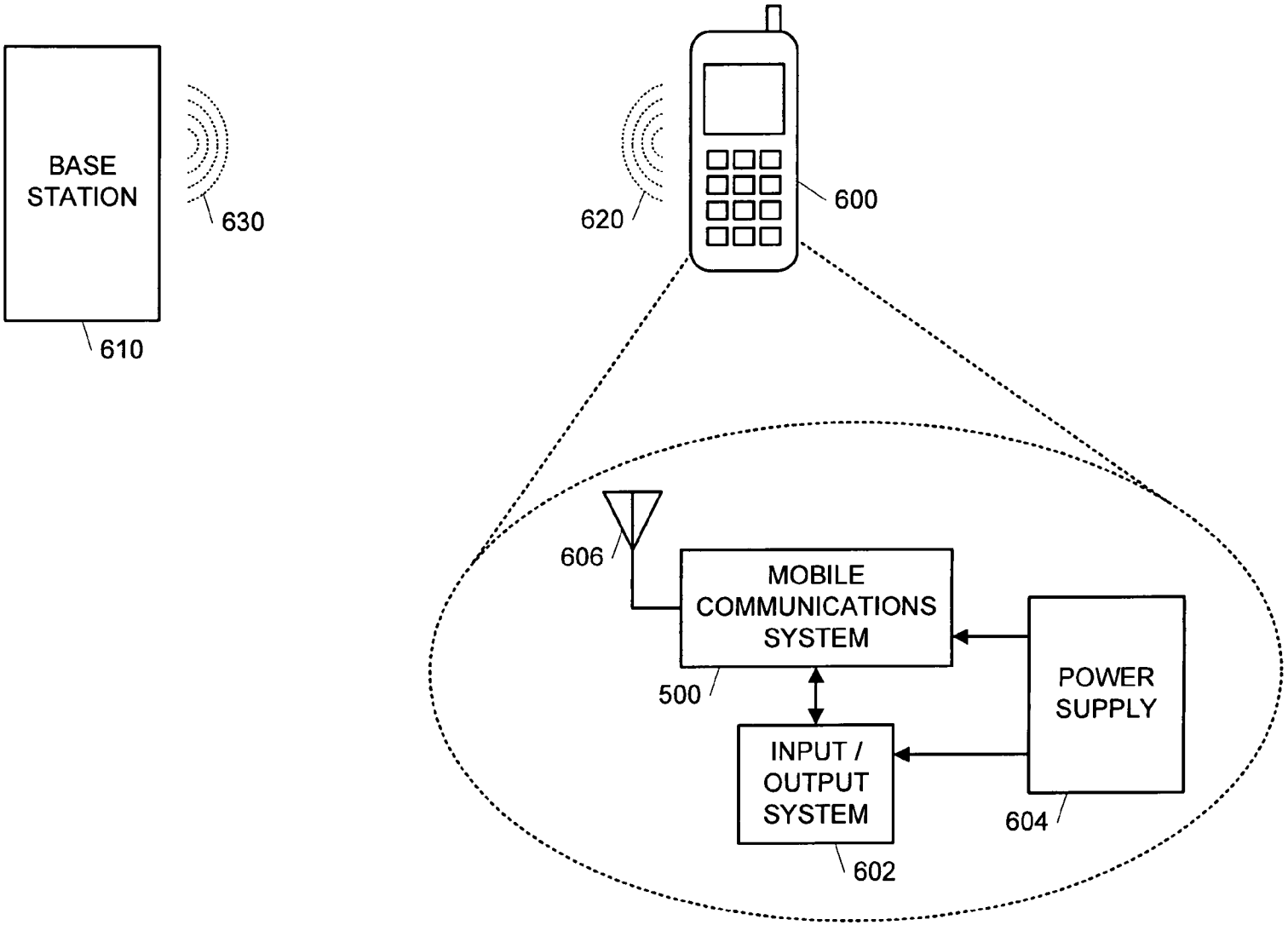
FIG. 6 is a block diagram illustrating one embodiment of a mobile device that includes the mobile communication system shown in FIG. 5.

RF circuitry 510 is configured to transmit and receive information using an antenna (e.g., an antenna 606 as shown in FIG. 6) coupled, directly or indirectly, to antenna interface circuitry 540. The information may comprise voice or data communications, for example.

RF circuitry 510 includes one or more instances of transmitter circuitry 512 configured to transmit information using antenna interface circuitry 540. To transmit information, transmitter circuitry 512 receives digital information to be transmitted from baseband processor circuitry 520, generates an RF signal in accordance with the information, and provides the RF signal to antenna interface circuitry 540 for transmission by an antenna. The RF signal may be amplified by power amplifier circuitry (not shown) prior to being transmitted by the antenna. In one embodiment, each instance of transmitter circuitry 512 is configured to transmit information using one or more frequency bands, e.g., a GSM 850, a EGSM, a PCS, or a DCS band.

RF circuitry 510 also includes one or more instances of receiver circuitry 514 configured to receive information using antenna interface circuitry 540. To receive information, receiver circuitry 514 receives an RF signal that includes information from a remote transmitter (e.g., a base station 610 as shown in FIG. 6) through an antenna, and antenna interface circuitry 540. The RF signal may be filtered by filter circuitry (not shown) prior to being received by receiver circuitry 514. Receiver circuitry 514 amplifies and down-converts the RF signal to convert the RF signal to digital information. Receiver circuitry 514 provides the digital information to baseband processor circuitry 520 for processing. In one embodiment, each instance of receiver circuitry 514 is configured to receive information from one or more frequency bands, e.g., a GSM 850, a EGSM, a PCS, or a DCS band.

Baseband processor circuitry 520 is configured to perform digital baseband processing, e.g., voice and/or data processing, on information to be transmitted by RF circuitry 510 and on information received by RF circuitry 510. Baseband processor circuitry 520 may also be configured to perform digital processing on other information that is not associated with RF circuitry 510, i.e., information that is not to be transmitted by or has not been received from RF circuitry 510.

Control circuitry 530 is configured to control the operation of the components of mobile communications system 500 including RF circuitry 510, baseband processor circuitry 520, and, according to one embodiment, the instances of voltage regulator 100. For example, control circuitry 530 is configured to activate and deactivate baseband processor circuitry 520. Control circuitry 530 is also configured to activate and deactivate RF circuitry 510. Control circuitry 530 is further configured to control the instances of voltage regulator 100 in one embodiment as described above with reference to FIG. 4. Control circuitry 530 includes any suitable combination of hardware and/or software components to perform the functions described herein.

Antenna interface circuitry 540 is configured to connect to an antenna, such as antenna 606 shown in FIG. 6, to allow RF signals to be transmitted and received by mobile communications system 500.

In the embodiment of FIG. 5, one instance of voltage regulator 100 provides a regulated voltage to a digital signal processing (DSP) circuit (not shown) in baseband processor circuitry 520, and one instance of voltage regulator 100 provides a regulated voltage to a divide-by-N circuit (not shown) in RF circuitry 510. In other embodiments, other instances of voltage regulator 100 may be included to provide one or more regulated voltages to other circuitry in mobile communication system 500.

Mobile communication system 500 may perform signal processing tasks in a serial or multiplexed manner (e.g., by sharing hardware to perform a variety of tasks), in a parallel manner (e.g., by using dedicated hardware for each signal processing task), or a combination of the two techniques. The choice of signal processing hardware, firmware, and software may depend on the design and performance specifications for a given desired implementation.

FIG. 6 is a block diagram illustrating one embodiment of a mobile communications device 600 that includes mobile communications system 500 as shown in FIG. 5. Mobile communications device 600 may be any type of portable communications device such as a mobile or cellular telephone, a personal digital assistant (PDA), and an audio and/or video player (e.g., an MP3 or DVD player). Mobile communications device 600 includes mobile communications system 500, an input/output system 602, a power supply 604, and an antenna 606.

Input/output system 602 receives information from a user and provides the information to mobile communications system 500. Input/output system 602 also receives information from mobile communications system 500 and provides the information to a user. The information may include voice and/or data communications. Input/output system 602 includes any number and types of input and/or output devices to allow a user provide information to and receive information from mobile communications device 600. Examples of input and output devices include a microphone, a speaker, a keypad, a pointing or selecting device, and a display device.

Power supply 604 provides power to mobile communications system 500, input/output system 602, and antenna 606. Power supply 604 includes any suitable portable or non-portable power supply such as a battery. In particular, power supply 604 provides power to one or more instances of voltage regulator 100 in mobile communications system 500.

Mobile communications system 500 communicates with one or more base stations 610 or other remotely located hosts in radio frequencies using antenna 606. Mobile communications system 500 transmits information to one or more base stations 610 or other remotely located hosts in radio frequencies using antenna 606 as indicated by a signal 620. Mobile communications system 500 receives information from a base station 610 in radio frequencies using antenna 606 as indicated by a signal 630. In other embodiments, mobile communications system 500 communicates with base stations 610 using other frequency spectra.

In the above embodiments, a variety of circuit and process technologies and materials may be used to implement communication apparatus according to the invention. Examples of such technologies include metal oxide semiconductor (MOS), p-type MOS (PMOS), n-type MOS (NMOS), complementary MOS (CMOS), silicon-germanium (SiGe), gallium-arsenide (GaAs), silicon-on-insulator (SOI), bipolar junction transistors (BJTs), and a combination of BJTs and CMOS (BiCMOS).

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A voltage regulator configured to receive a supply voltage from a voltage supply and provide a regulated voltage to digital circuitry, the voltage regulator comprising:

first circuitry configured to inhibit high frequency energy generated by the digital circuitry from transmitting into the voltage supply;

second circuitry configured to inhibit low frequency energy generated by the digital circuitry from transmitting into the voltage supply; and third circuitry, having two current sources and two transistors respectively connected to the two current sources, configured to maintain the regulated voltage at a substantially constant value in response to a first current drawn by the digital circuitry.

2. The voltage regulator of claim 1 wherein the third circuitry is configured to increase a second current drawn by the third circuitry in response to the first current decreasing, and wherein the third circuitry is configured to decrease the second current drawn by the third circuitry in response to the first current increasing.

3. The voltage regulator of claim 1 wherein the third circuitry is configured to provide shunt feedback.

4. The voltage regulator of claim 1 wherein the third circuitry is configured to provide a reference voltage as the regulated voltage.

5. The voltage regulator of claim 1 wherein the third circuitry includes a transistor that is configured to provide shunt feedback.

6. The voltage regulator of claim 1 wherein the third circuitry includes a frequency compensation circuit.

7. The voltage regulator of claim 1 wherein the first circuitry includes a capacitive element configured to inhibit the high frequency energy from transmitting into the voltage supply.

8. The voltage regulator of claim 1 wherein the second circuitry includes a constant current source configured to inhibit the low frequency energy from transmitting into the voltage supply.

9. The voltage regulator of claim 8 wherein the constant current source is configured to generate a second current, wherein the third circuitry is configured to draw a third current that is approximately equal to the second current minus the first current.

10. The voltage regulator of claim 1 wherein the second circuitry and a voltage reference are adjustable to allow the regulated voltage to be adjusted.

11. A method performed by a voltage regulator that includes current sources and transistors, the method comprising:

receiving a supply voltage from a voltage supply;

providing a regulared voltage to first circuitry;

inhibiting high frequency energy generated by the first circuitry using the regulated voltage from transmitting into the voltage supply;

inhibiting low frequency energy generated by the first circuitry using the regulated voltage from transmitting into the voltage supply; and maintaining the regulated voltage at a substantially constant value in response to a first current drawn by the first circuitry, using two of the current sources respectively connected to two of the transistors.

12. The method of claim 11 further comprising:

increasing a second current drawn by the voltage regulator in response to the first current decreasing; and decreasing the second current drawn by the voltage regulator in response to the first current increasing.

13. The method of claim 11 further comprising:

providing shunt feedback in the voltage regulator.

14. The method of claim 11 further comprising:

providing a reference voltage as the regulated voltage.

15. The method of claim 11 further comprising:

providing a frequency compensation circuit in the voltage regulator.

16. The method of claim 11 further comprising:

inhibiting the high frequency energy from transmitting into the voltage supply using a capacitive element.

17. The method of claim 11 further comprising:

inhibiting the low frequency energy from transmitting into the voltage supply using a constant current source.

18. The method of claim 11 further comprising:

generating a second current with a constant current source; and drawing a third current in the voltage regulator that is approximately equal to the second current minus the first current.

19. The method of claim 11 further comprising:

adjusting the regulated voltage using second circuitry that comprises control circuitry.

20. A system comprising:

circuitry; and a voltage regulator circuitry, having two current sources and two transistors respectively connected to the two current sources, configured to receive a supply voltage from a voltage supply and provide a regulated voltage to the circuitry;

wherein the voltage regulator is configured to inhibit high frequency energy generated by the circuitry from transmitting into the voltage supply, wherein the voltage regulator is configured to inhibit low frequency energy generated by the circuitry from transmitting into the voltage supply, and wherein the voltage regulator is configured to maintain the regulated voltage at a substantially constant value in response to a first current drawn by the circuitry.

21. The system of claim 20 wherein the voltage regulator is configured to provide shunt feedback.

22. The system of claim 20 wherein the voltage regulator is adjustable to allow the regulated voltage to be adjusted.

23. A communications device comprising:

an antenna;

a mobile communications system configured to communicate with a remote host using the antenna and including a voltage supply, circuitry, and a voltage regulator configured to receive a supply voltage from the voltage supply and provide a regulated voltage to the circuitry; and an input/output system configured to communicate with the mobile communications system;

wherein the voltage regulator circuitry has two current sources and two transistors respectively connected to the two current sources and is configured to inhibit high frequency energy generated by the circuitry from transmitting into the voltage supply, wherein the voltage regulator is configured to inhibit low frequency energy generated by the circuitry from transmitting into the voltage supply, and wherein the voltage regulator is configured to maintain the regulated voltage at a substantially constant value in response to a first current drawn by the circuitry.

24. The communications device of claim 23 wherein the voltage regulator is configured to provide shunt feedback.

25. The communications device of claim 23 wherein the voltage regulator includes a frequency compensation circuit.

26. The communications device of claim 23 wherein the voltage regulator is adjustable to allow the regulated voltage to be adjusted.

* * * * *